US005865324A

United States Patent [19]

Jay et al.

[11] Patent Number: 5,865,324

[45] Date of Patent: Feb. 2, 1999

[54] ROTO-TRACK DISPLAY DEVICE

[75] Inventors: Richard Jay, Westport, Conn.; Craig A. Neustadt, Palatine, Ill.

[73] Assignee: Display Technologies, Inc., Whitestone, N.Y.

[21] Appl. No.: 937,478

[22] Filed: Sep. 25, 1997

[51] Int. Cl.[6] ..... A47F 1/04

[52] U.S. Cl. ..... 211/59.2; 211/74; 211/75; 312/45

[58] Field of Search ..... 211/74, 59.2, 151, 211/75; 312/45; 221/281; 446/168

[56] References Cited

U.S. PATENT DOCUMENTS

| | | | |
|---|---|---|---|
| 1,320,362 | 10/1919 | Kriegsfield . | |
| 2,029,109 | 1/1936 | Kucher | 211/74 X |
| 2,029,263 | 1/1936 | Keighley | 211/74 X |
| 2,233,118 | 2/1941 | Williams . | |
| 2,581,363 | 1/1952 | Creedon . | |
| 2,678,735 | 5/1954 | Creedon | 211/74 |
| 2,729,914 | 1/1956 | Cook . | |
| 3,379,440 | 4/1968 | Jaffe . | |
| 3,501,016 | 3/1970 | Eaton | 211/74 X |
| 4,128,964 | 12/1978 | Ogasawara . | |
| 5,586,665 | 12/1996 | Brousseau | 312/45 X |

FOREIGN PATENT DOCUMENTS

| | | | |
|---|---|---|---|
| 2275181 | 8/1994 | United Kingdom | 221/281 |

*Primary Examiner*—Blair M. Johnson
*Attorney, Agent, or Firm*—Amster, Rothstein & Ebenstein

[57] ABSTRACT

A front-loading and front-discharging, exclusively gravity-feed display device for upright articles includes an exclusively gravity-feed track of a U-shaped design in plan, a U-shaped cross-section open at the top thereof, and a generally uniform article-supporting longitudinal incline extending downwardly along the length of the track. In a preferred embodiment, the track defines a loading or supply end, and a dispensing or delivery end, the loading and dispensing ends being in generally the same vertical plane. A U-shaped bight track section is spaced from the same vertical plane. An upper track section functionally connects the loading end and the bight track section, and a lower track section functionally connects the bight track section and the dispensing end. The upper, bight and lower track sections cooperatively and successively define a downwardly-extending article-supporting incline along the entire U-shaped length of the track.

14 Claims, 5 Drawing Sheets

ROTO-TRACK DISPLAY DEVICE

BACKGROUND OF THE INVENTION

The present invention relates to a front-loading and front-discharging, exclusively gravity-feed display device for upright articles with functionally flat bottoms (e.g., bottles and cans), and more particularly to such devices which are easy to load and suitable for use on grocery store shelves.

It is well known to provide a front-loading and front-discharging, exclusively gravity-feed display device for upright articles with functionally flat bottoms, such as cans, bottles and the like. A basic example of such a device would be a single-channel display device that was tilted forwardly and downwardly, with loading and discharging of the articles being from the front thereof. A clear disadvantage of this construction is that, in order to load additional articles from the front of the device, each of the articles already on the device must be moved rearwardly and upwardly so as to make room for the added articles. Thus, loading of the device is a tedious, time-consuming and laborious task.

As a result, where access to the rear of the device is possible, such devices are typically rear-loaded, so that the loader simply has to drop the added articles into any of the available spaces behind the articles already on the track. Gravity then moves the added articles forwardly for a front discharge from the device. However, in many instances the rear of the device is simply not easily accessible for loading purposes, thus requiring the tedious, time-consuming and laborious loading process described above.

Further, in such a front-loading and front-discharging device there is no automatic rotation of the stock or merchandise on a FIFO (first-in first-out) basis; thus, there is a possibility of merchandise such as soda becoming stale or losing its freshness, as will occur on a store shelf over a period of months, even in an unopened bottle or can. Thus, a front-loading and front-discharging device of the type described requires store personnel to periodically rotate the stock on the display device in order to prevent stagnation.

U.S. Pat. No. 5,586,665 and U.S. Pat. No. 5,595,310 disclose front-loading and front-discharging, exclusively gravity-feed display devices for upright articles. Typically, these devices include a loading or supply end and a dispensing or delivery end. A U-shaped bight track section is provided along with an upper track section, which functionally connects the loading end and the bight track section, and a lower track section, which functionally connects the bight track section and the dispensing end. In both instances, the bight track section is elevated relative to the loading and dispensing ends. Each of the patents discloses an embodiment in which the articles are supported by their necks. The '310 Patent also discloses such a device without a neck-support system, so that the upright articles slide along the track of the device on functionally flat bottoms. However, in each case, it is necessary for the person performing the front-loading operation to push each of the articles from the loading inlet up an inclined track to the bight of a track curve (against the weight of all the articles already on that inclined track) before the added articles can commence to move by gravity from the bight or curve of the track to the dispensing outlet. In other words, in these devices the bottles do not move all the way from the loading inlet to the dispensing outlet under the influence of gravity.

Accordingly, it is an object of the present invention to provide a front-loading and front-discharging, exclusively gravity-feed display device for upright articles offering a rapid and easy loading operation.

Another object is to provide such a device wherein the loader does not have to move the new stock upwardly and rearwardly against the weight of all or even half of the articles already on the device.

A further object is to provide such a device which allows articles to move from the loading inlet all the way to the dispensing outlet under the influence of gravity.

It is another object of the present invention to provide such a device wherein all of the articles between the loading end and the dispensing end can be dispensed via a single dispensing end on a FIFO basis without any rotation or other adjustment of the articles on the device.

SUMMARY OF THE INVENTION

It has now been found that the above and related objects of the present invention are obtained in a front-loading and front-discharging, exclusively gravity-feed display device for upright articles. The device comprises an exclusively gravity-feed track of a U-shaped design in plan open at the front thereof and a U-shaped cross-section open at the top thereof. The track defines a generally uniform article-supporting longitudinal incline extending downwardly along the length of the track.

In a preferred embodiment the track defines a loading or supply end, and a dispensing or delivery end, the loading and dispensing ends being in generally the same vertical plane. A U-shaped bight track section is spaced from the same vertical plane. An upper track section functionally connects the loading end and the bight track section, and a lower track section functionally connects the bight track section and the dispensing end. The upper, bight and lower track sections cooperatively and successively define a downwardly-extending article-supporting incline along the entire U-shaped length of the track.

Preferably, the upper, bight and lower track sections define a downwardly-extending article-supporting incline of generally uniform inclination. The bight track section has either a stepped article-supporting surface or a smoothly inclined article-supporting surface.

In another preferred embodiment, each of the upper and lower track sections includes a base for supporting articles thereon and a pair of sidewalls upstanding therefrom to define the U-shaped cross-section, one of the pair of sidewalls being an outer sidewall and the other being an inner sidewall. The bight track section includes a base for supporting articles thereon and an outer sidewall, the outer sidewall of the bight track section functionally connecting the outer sidewalls of the upper and lower track sections for assistance in maintaining the articles upright as they travel along the bight track section. The bight track section also includes an inner sidewall, the inner sidewall of the bight track section preferably functionally connecting the inner sidewalls, respectively, of the upper and lower track sections for assistance in maintaining the articles upright as they travel along the bight track section. Alternatively, the bight track section also includes, as the inner sidewall, a vertically-extending bumper disposed at or intermediate the inner sidewalls of the upper and lower track sections for assistance in maintaining the articles upright as they travel along the bight track section The present invention further encompasses both a vertical stack of the display devices, additionally including means for stacking the devices one above the other in vertical alignment, or a horizontal bank of the display devices, additionally including means for horizontally banking the devices side by side in horizontal alignment. The outer sidewall preferably extends upwardly from the base further in the bight track section than in the upper and lower track sections.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
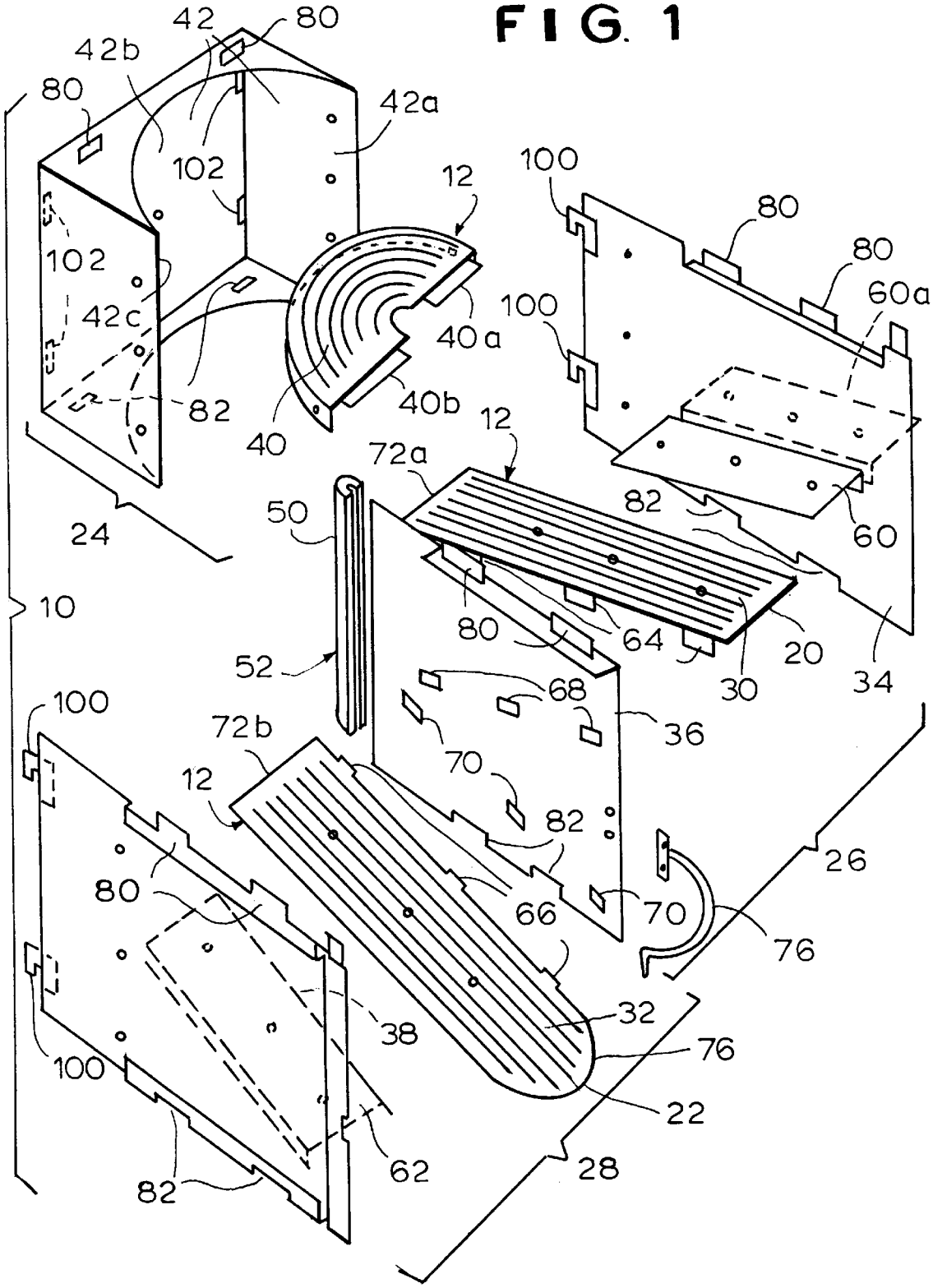
FIG. 1 is an exploded isometric view of a display device according to the present invention.
Figure 2:
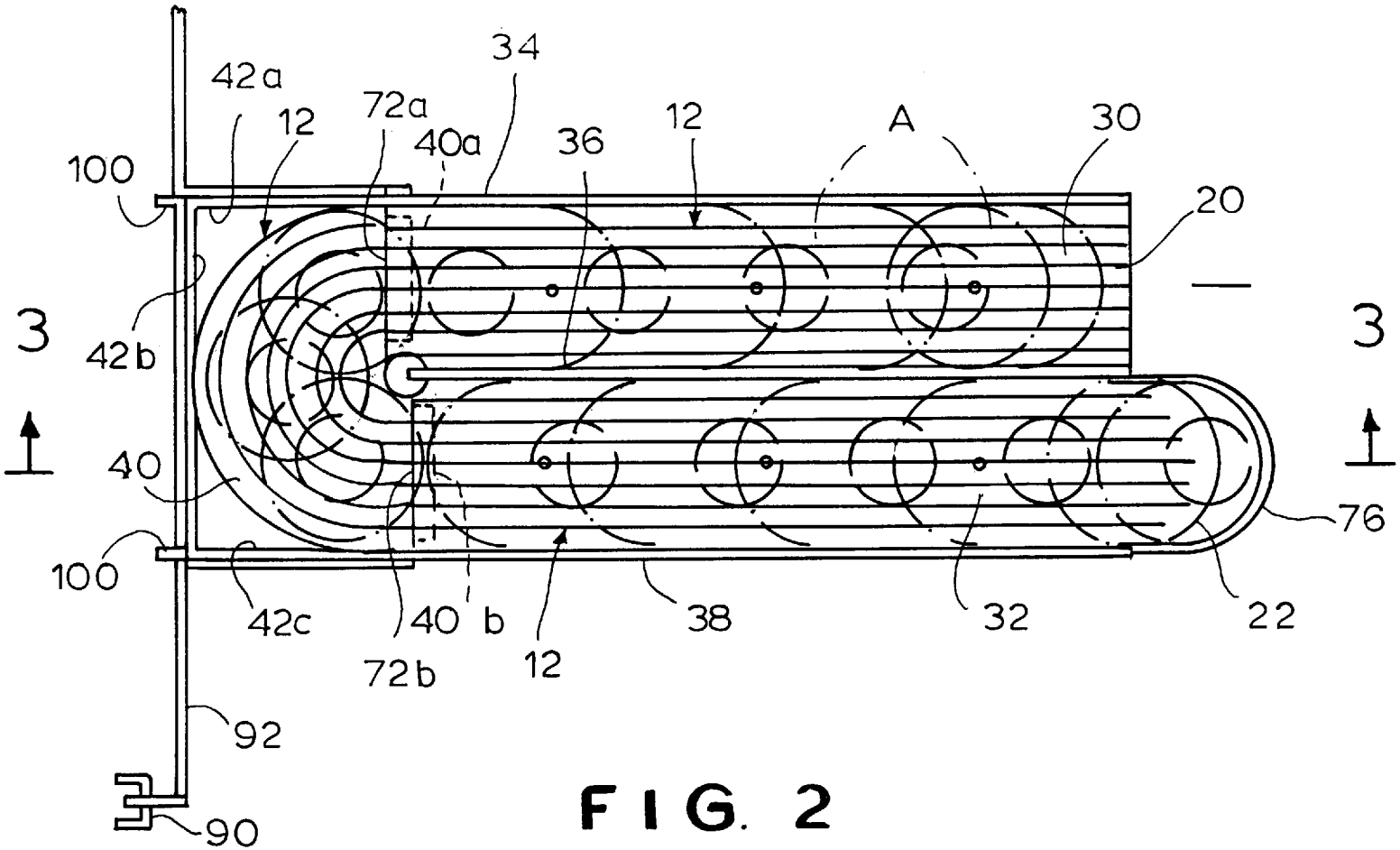
FIG. 2 is a top plan view of the assembly, with a plurality of bottles thereon illustrated in phantom line.
Figure 3:
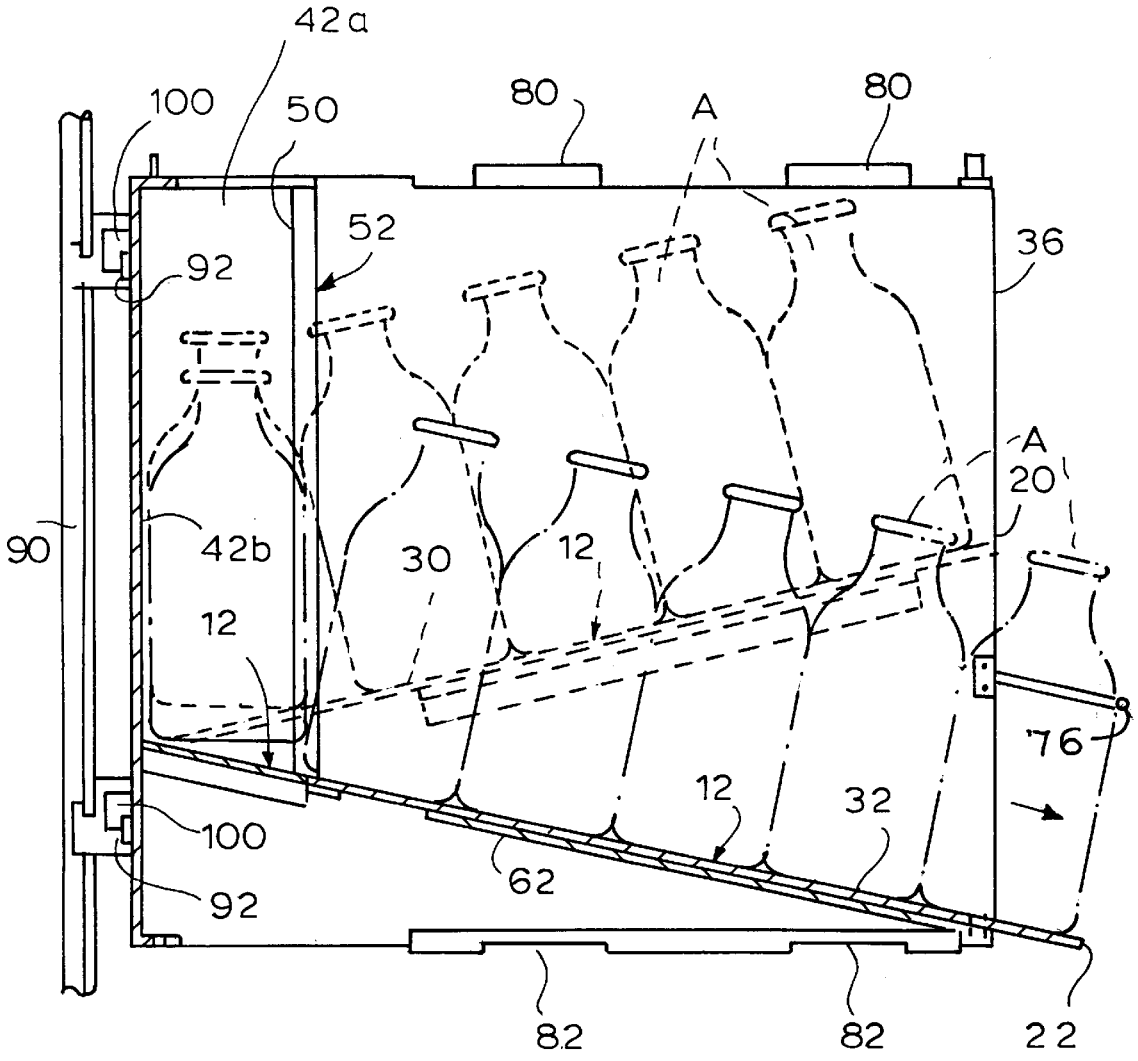
FIG. 3 is a sectional view thereof taken along the line 3—3 of FIG. 2.

Referring now to the drawing, and in particular to FIGS. 1–3 thereof, therein illustrated is a front-loading and front-discharging, exclusively gravity-feed display device for upright articles according to the present invention, generally designated by the reference numeral 10. The display device 10 comprises an exclusively gravity-feed track, generally designated 12, having a U-shaped design in plan open at the front thereof and a U-shaped cross-section open at the top thereof. The track 12 defines a generally uniform article-supporting longitudinal incline extending downwardly along the length of the track. In FIGS. 2 and 3 the articles A are illustrated as bottles and have functionally flat bottoms so they will slide along an inclined ramp or track.

More particularly, the track 12 defines a loading or supply end 20, a dispensing or delivery end 22, and a U-shaped bight track section 24. The loading and dispensing ends 20, 22 are in generally the same vertical plane (so that they may be adjacent or slightly overhanging the front of a store shelf), but the U-shaped bight track section is substantially spaced rearwardly from the same vertical plane (so that it is preferably adjacent the rear of the store shelf). An upper track section 26 functionally connects the loading end 20 and the bight track section 24, while a lower track section 28 functionally connects the bight track section 24 and the dispensing end 22. The upper, bight and lower track sections 26, 24 and 28 cooperatively and successively define a downwardly extending, article-supporting incline along the entire U-shaped length of the track 12. The precise angle of inclination may vary for the various track sections so as to increase or decrease the speed with which articles can pass along the particular track sections. Preferably, the upper, bight and lower track sections 26, 24 and 28 together define a generally uniform inclination.

FIGS. 2 and 3 illustrate in phantom line bottle-type articles A, with functionally flat bottoms, supported on the track 12.

As best seen in FIG. 2, each of the upper and lower track sections 26, 28 includes a base or ramp 30 and 32 for supporting articles A thereon and a pair of sidewalls 34 and 36, 36 and 38 upstanding from the base 30, 32, respectively, to define the U-shaped cross-section of these upper and lower track sections. One of each pair of sidewalls 34, 36 and 36, 38 is an outer sidewall (as illustrated, the sidewalls 34 and 38), and the other of each pair of sidewalls is an inner sidewall (as illustrated, common sidewall 36). While the use of a common sidewall 36 between the upper and lower track sections 26, 28 facilitates economic manufacture of the display device, separate inner sidewalls may be provided, one being an inner sidewall of the upper track section 26 and the other being an inner sidewall of the lower track section 28. It will be appreciated that the common inner sidewall 36 of the upper and lower track sections 26, 28 may be thought of as providing on one surface thereof an inner sidewall for the upper track section 26, and on the other surface thereof an inner sidewall for the lower track section 28.

As illustrated in FIG. 1, in the lower track section 28 at the dispensing end 22, a convexly curved front transverse member 76 extending between the inner sidewall 36 and outer sidewall 38 may be employed to arrest the forward motion of the lead article and prevent it from falling off the lower track 32. Alternatively or in addition, an upwardly extending lip (not shown) may be used to arrest the passage of the lead article and maintain the lead article and those therebehind within the display device. Clearly, a variety of different mechanisms for arresting the forward motion of the lead article are well known in the art and adaptable for this purpose.

The outer sidewalls 34, 38 of the track sections 26, 28 are provided with a vertically extending series of small apertures which may be aligned with a corresponding vertically extending series of small apertures provided on the outer sidewall sections 42*a*, 42*c*, respectively, of the bight track section 24, so that they may be secured together—e.g., by screws or nuts and bolts (not shown)—to form a functionally continuous outer sidewall for the device and to assist in maintaining the device together. Alternatively, shoulders or like conventional support means may be employed on the inner surface of the outer sidewall 42 to provide direct support for the bight track section 40.

The bight track section 24 includes a base or ramp 40 for supporting articles thereon and an outer sidewall 42. While the bight track section 24 is illustrated as having a smoothly inclined, article-supporting base or ramp 40, it will be apparent to those skilled in the art that alternatively it may have a stepped article-supporting base or ramp. The U-shaped outer sidewall has interconnected surfaces 42*a*, 42*b* and 42*c* and functionally connects the outer sidewalls 34, 38 of the upper and lower track sections 26, 28, respectively, for assistance in maintaining the articles as they travel along the bight track section 24. In the illustrated embodiment, a bight track section includes a base 40, an outer sidewall 42 and an inner sidewall 50, the inner and outer sidewalls 50, 42 of the bight track section 24 functionally connecting the inner and outer sidewalls 36 and 34, 36 and 38, respectively, of the upper and lower track sections 26, 28 for assistance in maintaining the articles upright as they travel along the bight track section 24. Preferably, as illustrated, the bight track section 24 includes as the inner sidewall 50 thereof, a vertically extending bumper, generally designated 52, disposed about and secured to the inner common back edge of the sidewall 36 of the upper and lower track sections 26, 28. The bumper 52 is preferably U-shaped in plan cross-section so that it partially receives therein a rear edge of the common inner sidewall 36, thereby to form a functionally continuous inner sidewall for the device. Other means well known to those skilled in the art may also be used for securing the bumper 52 to the common inner sidewall 36.

The bight track 40 further preferably includes extensions 40*a* and 40*b,* which are disposed below and assist in supporting the adjacent ends 72*a* and 72*b,* respectively, of the upper and lower inclined tracks 30, 32.

The tracks or ramps 30, 32, 40 may be relatively smooth or provided with upstanding ridges to minimize friction between the tracks and the articles A passing thereover. Additionally, they may be provided with openings to facilitate the passage of air (e.g., cooling air) through the device and about the articles A thereon.

Figure 4:
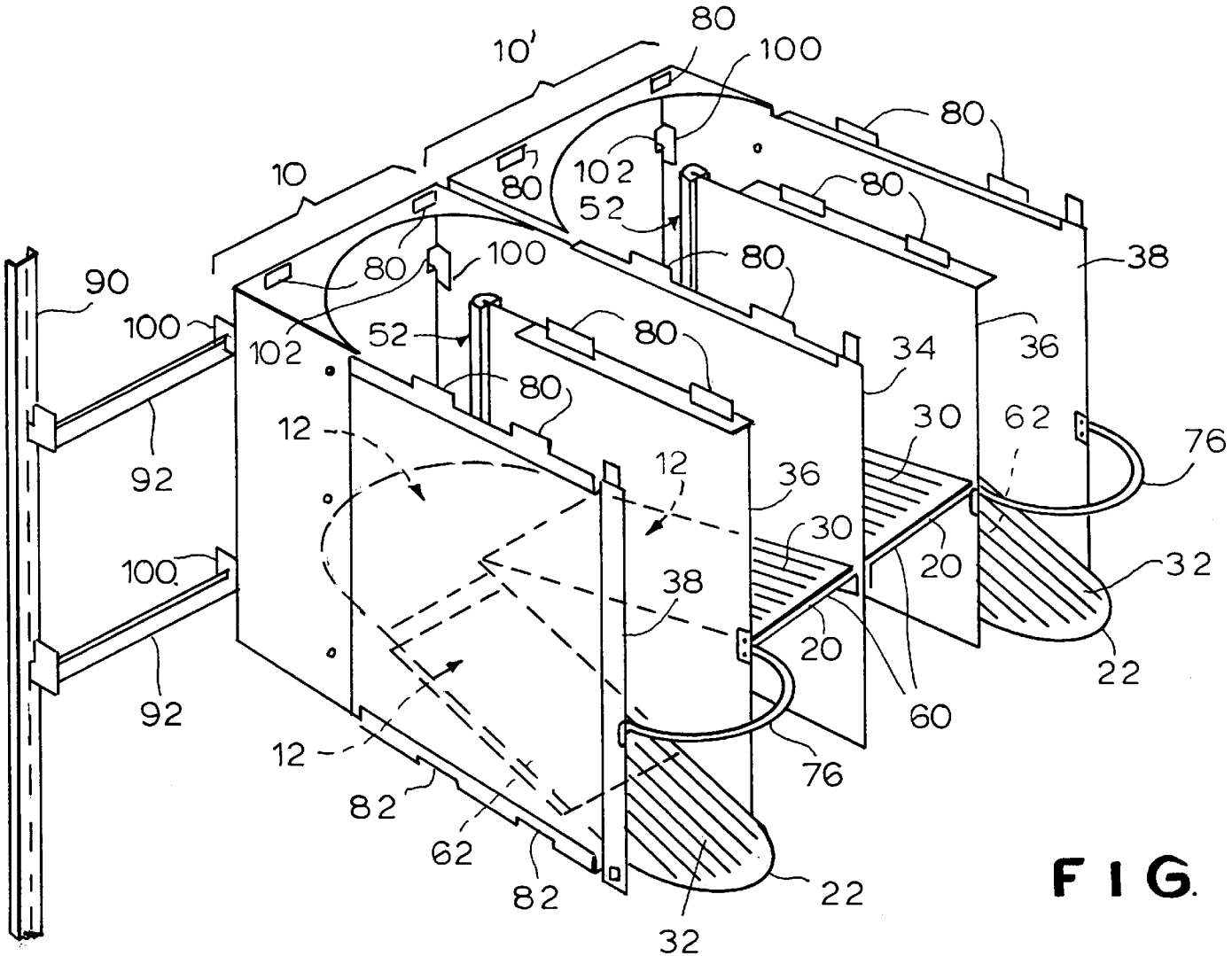
FIG. 4 is an isometric view of a horizontal bank of the devices.
Figure 5:
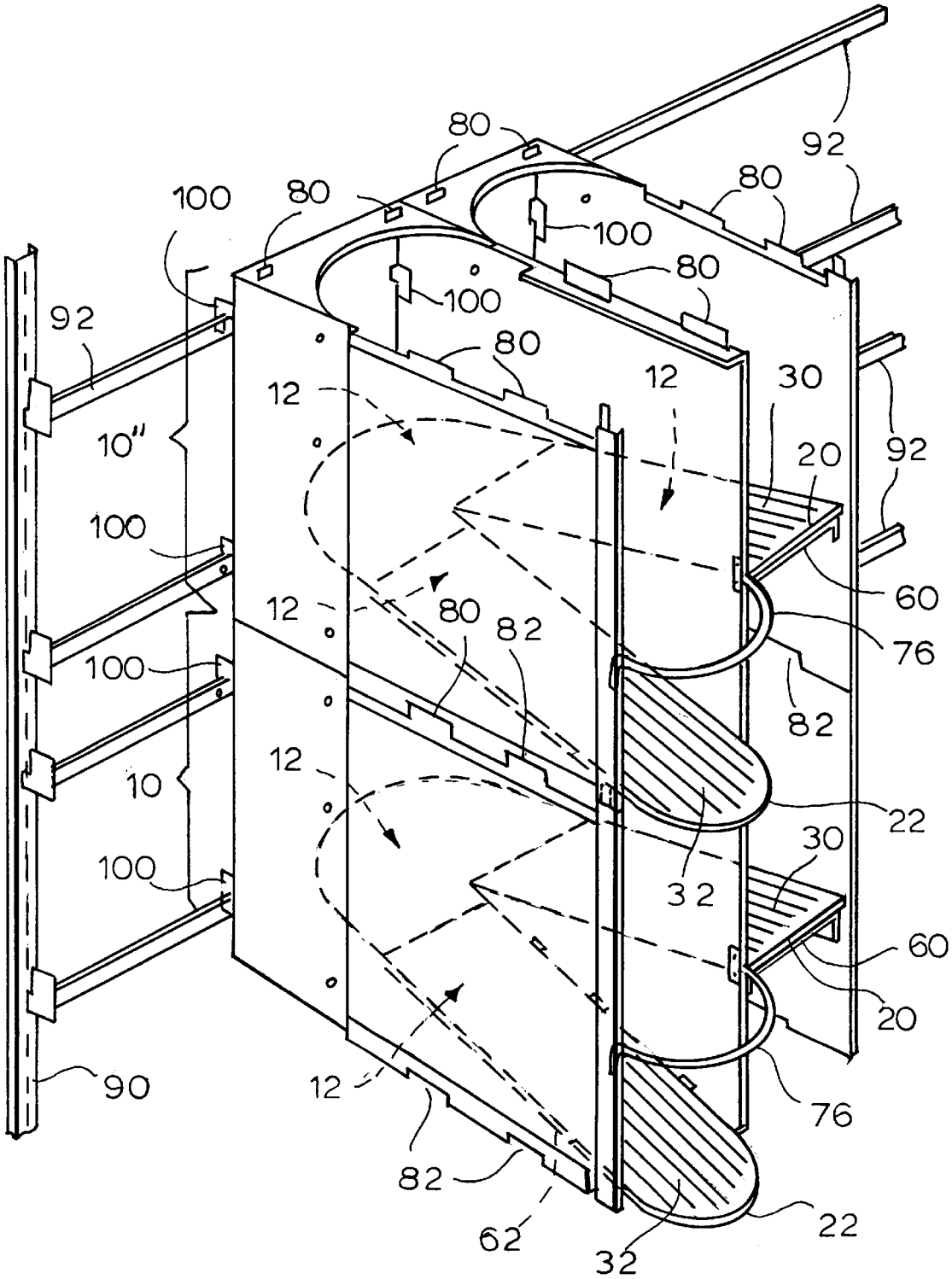
FIG. 5 is an isometric view of a vertical stack of the devices.

The embodiment of the present invention illustrated in FIGS. 1–3 is particularly well suited for ease of manufacture and affords the advantage of a display device which includes both means for stacking the tracks 12 one above the other in aligned vertical relationship, and means for horizontally banking the tracks 12 side by side in aligned horizontal relationship, as illustrated in FIGS. 4 and 5, respectively.

In a single display device 10, the outer sidewalls 34, 38 of the upper and lower track sections 26, 28 may be formed of generally planar plates, each plate being oriented in a respective vertical plane. An inwardly and downwardly extending support flange 60, 62 is secured to the respective outer sidewalls 34, 38 to provide support for the tracks 30, 32 of the upper and lower track sections 26, 28. Additionally, each of the upper and lower tracks 30, 32 defines a plurality (here, three) of depending flanges 64, 66, respectively, for receipt within appropriate apertures in the common inner sidewall 36. The depending flanges 64, 66 are received in apertures 68, 70, respectively, of the common inner sidewall 36. Thus, the upper and lower tracks 30, 32 are each supported on both sides: on the outer sides by the flanges 60, 62, and on the inner sides by the engagement of flanges 64, 66 in the respective apertures 68, 70 of the common inner sidewall 36. Of course, the flanges 60, 62 and the apertures 60, 70 are disposed so as to ensure that the upper and lower tracks 30, 32 define appropriate downwardly extending article-supporting inclined surfaces. Further, for most applications the construction will ensure that the upper and lower track 30, 32 do not tip to one side or the other, thereby to promote the passage of the articles on the track intermediate the track section sidewalls.

Preferably, the upper and lower tracks 30, 32 and their respective support flanges 60, 62 define a plurality of small apertures to facilitate securing each track and its support flange together—e.g., by screws or nuts and bolts (not shown)—to assist in maintaining the device together.

The outer sidewalls 34, 38 of the track sections 26, 28 are provided with a vertically extending series of small apertures which may be aligned with a corresponding vertically extending series of small apertures provided on the outer sidewall sections 42*a,* 42*c,* respectively, of the bight track section 24, so that they may be secured together—e.g., by screws or nuts and bolts (not shown)—to form a functionally continuous outer sidewall for the device Referring now to FIG. 4 in particular, if it is desired to have a bank of horizontally aligned display devices 10, side by side, one or more of the outer sidewalls 34, 38 of the first device 10 may be provided with an outwardly extending flange 60*a* (as shown for sidewall 34 in FIG. 1), thereby to act as a common outer sidewall for the two devices and provide support for the upper track section of the adjacent display device 10'. It should be appreciated that the second or adjacent display device 10' in FIG. 4 is a mirror image of the first display device 10. Additionally, one of the outer sidewall segments 42*a,* 42*c* of the device 10 may be secured—by screws, nuts and bolts, or the like (not shown)—to the bight outer sidewall section of an adjacent display device 10'. It will be appreciated by those skilled in the art that various other means well recognized in the art may be employed instead of the apertures and screws or nuts and bolts in order to allow for horizontal banking of the display devices.

Referring now to FIG. 5 in particular, if it is desired to have a stack of vertically aligned display devices, one atop the other, the inner and outer sidewalls may define tabs 80 on one of the top and bottom surfaces (here, the top surface) and recesses 82 on the other of the surfaces (here, the bottom surface). For example, as illustrated in FIGS. 1 and 5, the upstanding tabs 80 of the top of a display device 10 are adapted to be received in the recesses 82 of the bottom of a display device 10' placed atop thereof. It will be appreciated by those skilled in the art that various other means well recognized in the art may be employed instead of the tabs 80 and recesses 82 in order to allow for vertical stacking of the display devices.

It will be appreciated that the auxiliary flange 60*a* is not required unless it is desired to horizontally bank display devices. Similarly, it will be appreciated that the tabs 80 and recesses 82 are not required unless it is desired to vertically stack display devices. Thus, the tabs/recesses and auxiliary flanges form no part of the present invention in an embodiment where there is only one display device.

As will be apparent to those skilled in the art, the banks and stacks may be extended to include more than two of the display devices.

Referring now to FIGS. 2–5, and in particular FIGS. 4 and 5, the display device according to the present invention (as well as banks and stacks thereof) is particularly well suited for use in conjunction with a structure provided in many stores for hanging displays. Such a structure typically involves a pair of uprights or standards and a plurality of vertically spaced horizontal attachment members 92 extending therebetween and adapted to support displays placed thereon. For cooperation with such a structure, the rear ends of the outer sidewalls 34, 38 (adjacent the bight outer sidewall section 42) are provided with a pair of vertically spaced, downwardly opening hooks or brackets 100 adapted to be mounted on a pair of the attachment members 92 of the store structure. The bight outer sidewall 42 is provided with slits 102 through which the rear portions of the hooks or brackets 100 extend so that the rear portions are available for mounting on the horizontal members 92, as illustrated in FIGS. 2–5.

Because the articles move from the loading end to the dispensing end on a FIFO basis, no rotation or other adjustment of the articles on the device is necessary to ensure freshness of the product. The device is easily and rapidly loaded as the loader does not have to move the new stock upwardly and rearwardly against the weight of all, or even half, of the articles already on the device. Further, once the device is loaded, all of the articles move from the loading inlet all the way to the dispensing outlet under the influence of gravity.

To summarize, the present invention provides a front-loading and front-discharging, exclusively gravity-feed display device for upright articles offering a rapid and easing loading operation as the loader does not have to move the new stock upwardly and rearwardly against the weight of all or even half of the articles already on the device. The device allows articles to move from the loading inlet all the way to the dispensing inlet under the influence of gravity, and all of the articles between the loading end and the dispensing end can be dispensed via a single dispensing end on a FIFO basis without any rotation or other adjustment of the articles on the device.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A front-loading and front-discharging, exclusively gravity-feed display device for upright articles, comprising:

an exclusively gravity-feed track of a U-shaped vertical design in top plan open at the front thereof, said track having an upper free end, a lower free end, verticallv extending first outer sidewalls adjacent opposing legs of said U-shaped track, and vertically extending first inner sidewalls parallel with said first outer sidewalls and located therebetween, said first outer sidewalls each having a height defined by a lower edge thereof at the level of said lower free end and an upper edge thereof spaced above said upper free end, said track defining a generally uniform article-supporting longitudinal incline extending downwardly along the length of said track from said upper free end to said lower free end between respective first outer sidewalls and first inner sidewalls.

2. The device of claim 1 wherein said track defines:

(i) a loading or supply end including said upper free end, (ii) a dispensing or delivery end including said lower free end, said loading and dispensing ends being in generally the same vertical plane, (iii) a bight track section spaced from the same vertical plane and defining the curved bottom portion of the "U", (iv) an upper track section functionally connecting said loading end and said bight track section, and (v) a lower track section functionally connecting said bight track section and said dispensing end;

said upper, bight and lower track sections cooperatively and successively defining said downwardly-extending article-supporting incline extending lengthwise along the entire U-shaped length of said track.

3. The device of claim 2 wherein said upper, bight and lower track sections define said downwardly-extending article-supporting incline having generally uniform inclination.

4. The device of claim 2 wherein said article-supporting surface of said bight track section is smoothly inclined.

5. The device of claim 2 wherein each of said upper and lower track sections includes a base for supporting articles thereon and a pair of sidewalls upstanding therefrom, one of said pair of sidewalls being a first outer sidewall and the other being a first inner sidewall.

6. The device of claim 5 wherein said bight track section includes a base for supporting articles thereon, a second inner sidewall and a second outer sidewall, said second outer sidewall functionally connecting said first outer sidewalls for assistance in maintaining the articles upright as they travel along said bight track section.

7. The device of claim 6 wherein said second inner sidewall extends upwardly from said base at least as far as said second outer sidewall.

8. The device of claim 6 wherein said bight track section includes said base, said second outer sidewall and said second inner sidewall, said second inner and outer sidewalls functionally connecting said first inner and outer sidewalls, respectively, for assistance in maintaining the articles upright as they travel along said bight track section.

9. The device of claim 6 wherein said bight track section includes said base, said second outer sidewall and, as said second inner sidewall, a vertically-extending bumper disposed adjacent said first inner sidewalls.

10. A front-loading and front-discharging, exclusively gravity-feed display device for upright articles, comprising:

an exclusively gravity-feed track of a U-shaped design in top plan open at the front thereof, said track having an upper free end, a lower free end, vertically extending first outer sidewalls adjacent opposing legs of said U-shaped track, and vertically extending first inner sidewalls parallel with said first outer sidewalls and located therebetween, said first outer sidewalls each having a height defined by a lower edge thereof at the level of said lower free end and an upper edge thereof spaced above said upper free end, said track defining a generally uniform article-supporting longitudinal incline extending downwardly along the length of said track, said track defining:

(i) a loading or supply end, including said upper free end, (ii) a dispensing or delivery end, including said lower free end, said loading and dispensing ends being in generally the same vertical plane, (iii) a bight track section spaced from the same vertical plane and defining the curved bottom portion of the "U", (iv) an upper track section functionally connecting said loading end and said bight track section, and (v) a lower track section functionally connecting said bight track section and said dispensing end;

said upper, bight and lower track sections cooperatively and successively defining said downwardly-extending article-supporting incline extending lengthwise along the entire U-shaped length of said track from said upper free end to said lower free end between respective first outer sidewalls and first inner sidewalls;

each of said upper and lower track sections including a base for supporting articles thereon and a pair of first inner and outer sidewalls upstanding therefrom said bight track section including a base, a second outer sidewall functionally connecting said first outer sidewalls, and, as a second inner sidewall, a vertically-extending bumper disposed adjacent said first inner sidewalls for assistance in maintaining the articles upright as they pass along said bight track section.

11. The device of claim 1 additionally including means for stacking a plurality of said display devices one above the other in vertical alignment.

12. The device of claim 1 additionally including means for horizontally banking a plurality of said display devices side by side in horizontal alignment.

13. In combination, the device of claim 1 and a plurality of upright articles supported thereby.

14. The combination of claim 13 wherein each of said upright articles makes a sliding, but non-rotating, contact with said incline.

* * * * *